United States Patent [19]

Neuwahl

[11] Patent Number: 4,728,108

[45] Date of Patent: Mar. 1, 1988

[54] PACK OF PLAYING CARDS

[75] Inventor: Nicolaas Neuwahl, Bagno A Ripoli, Italy

[73] Assignee: NFFX Design di Vanna Gazzeri & C.S.a.s., Bagno A Ripoli, Italy

[21] Appl. No.: 947,763

[22] Filed: Dec. 24, 1986

[30] Foreign Application Priority Data

Jan. 7, 1986 [IT] Italy ..... 11507/86[U]

[51] Int. Cl.[4] ..... A63F 1/00

[52] U.S. Cl. ..... 273/296

[58] Field of Search ..... 273/274, 292, 296, 297, 273/303, 304, 305, 306, 308

[56] References Cited

U.S. PATENT DOCUMENTS

| | | | |
|---|---|---|---|
| 1,188,204 | 6/1916 | Pitt | 273/296 |
| 2,812,181 | 11/1957 | Richman | 273/296 X |
| 3,667,757 | 6/1972 | Holmberg | 273/274 |
| 4,294,451 | 10/1981 | Wollner | 273/304 |
| 4,428,582 | 1/1984 | Smith | 273/296 |

*Primary Examiner*—Anton O. Oechsle

*Attorney, Agent, or Firm*—Browdy and Neimark

[57] ABSTRACT

The invention relates to a pack of playing cards comprising a plurality of card suits each formed of cards having first like markings applied to obverse faces of the cards, at least some of said suits being different from one another by the number of the cards which comprise them, a plurality of card sets formed of cards having second mutually alike markings applied to the reverse sides of the cards, and a plurality of sub-suits of cards each formed of cards having first mutually alike markings and second mutually alike markings, each suit including a number of sub-suits which is equal to the number of said sets and at least some of the suits including sub-suits which differ from one another by the number of their cards.

5 Claims, 7 Drawing Figures

PACK OF PLAYING CARDS

BACKGROUND OF THE INVENTION

This invention relates to a pack of playing cards.

As is known, there exist many different kinds of playing card packs, each having distinctive peculiarities. It is nonetheless possible to pinpoint some typical features shared by most of the card packs known heretofore.

A first, important feature generally exhibited by prior card packs is that each of the cards in the pack has on one side an obverse face or front carrying either symbols or pictures or numbers peculiar to a game, and on the opposite side, a reverse face or back carrying a generic pattern unrelated to the game. Each card may, therefore, be told from the others in any one pack by just said obverse face, the reverse face being invariably the same for all cards to prevent players from singling out the cards in the hands of the other players, or in a deck when the cards are laid down overturned.

Moreover, the reverse faces of cards from different packs usually are not identified with any specific symbols and may just have, for example, different colors or different decorative patterns.

Another common feature of conventional playing card packs is the following: different packs of one kind, or intended for playing a specific game, or having one type of symbols on their marked card faces, all have their cards with the same or like symbols, in the various packs, for combination into sets of equal numerical consistency. This in order to leave the range of playable games unaltered when the card packs are changed. Accordingly, packs of one kind not only comprise an equal number of cards but also one and the same numerical distribution of like cards.

A further feature is that, with each pack, the various sets of cards have, at least in a majority of cases, the same numerical consistency in relation to the number of the cards comprising them. Thus, a like numerical distribution also occurs in most cases among the different cards in one pack.

The presence of one or more of the general features outlined above results in conventional playing card packs being unsuitable for chance games, where it is important that drawing a given number of cards randomly from a deck yields results which be difficult to foretell and much varied, with a wide range of drawing probabilities for the various cards. In fact, with currently used cards, it is a relatively easy matter to tell which cards remain to be played, based upon those already played. Furthermore, nearly all the cards in each pack, or in the various packs, have initially the same probability of being drawn.

Thus, it has been difficult to play varied and really appealing games where these are based on random drawing of conventional pack cards.

It should be further noted that conventional playing cards carry in many cases, on their marked faces, combinations of numbers and pictures which are relatively complex or at least more appropriate for a pondered and scrutinizing game procedure than an appealing and swift one, or game of chance, which may be played in quite an expedite fashion and require instantaneous visualization of cards.

These relatively complex combinations of numbers and pictures also result in that any advertising representations are difficult to add to such cards if they are not to distract the player.

Furthermore, the value of such advertising representations is of little consequence with known games because of their role in a game being quite immaterial.

OBJECTS OF THE INVENTION

In view of the above-outlined situation, it is the general object of this invention to provide a novel type of playing card pack which can substantially obviate the problems set forth in the foregoing.

Within this general object, a particular object of the invention is to provide a playing card pack which can be readily utilized even for chance games, e.g. of the kind of those played on slot or jackpot machines.

These objects are substantially achieved by a pack of playing cards which comprises:

- a plurality of cards having obverse faces, first markings on said obverse faces, reverse faces oppositely from said obverse faces, and second markings selectively applied to said reverse faces;
- a plurality of card suits, each comprising cards carrying like first markings, at least some of said suits being also diversified from one another by the number of the cards comprising them;
- a plurality of card sets, each comprising cards carrying said second mutually alike markings, said sets including an equal number of cards; and
- a plurality of sub-suits of cards, each comprising cards carrying both first and second mutually alike markings;
- each said suit including a number of said sub-suits which at least approximate the number of said sets, and at least some of said suits including sub-suits which differ from one another by the number of their cards.

BRIEF DESCRIPTION OF THE DRAWINGS

Further features and advantages of the invention will be more clearly apparent from a description of a preferred embodiment of a playing card pack, as shown by way of illustration and not of limitation in the accompanying drawings, where.

DESCRIPTION OF THE PREFERRED EMBODIMENT

Figure 1:
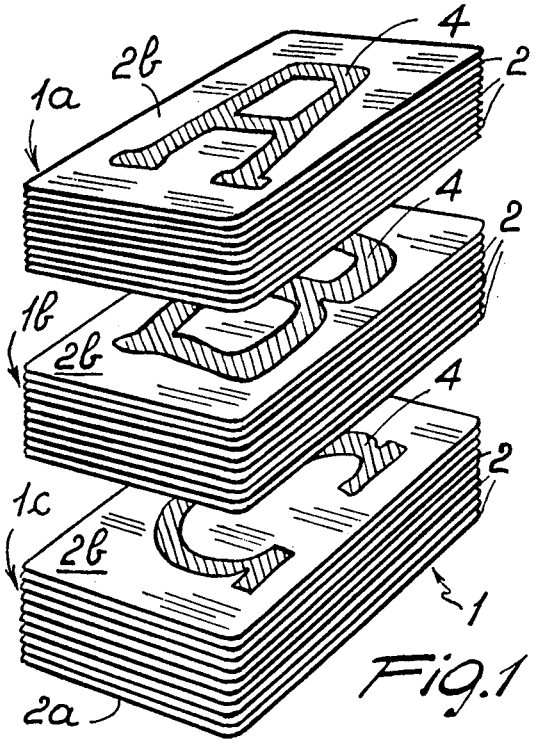
FIG. 1 shows in perspective a pack according to the invention.
Figure 2:
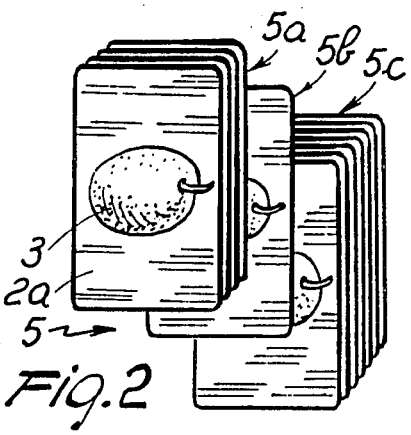
FIGS. 2,3,4,5,6, and 7 show the various cards comprising the pack of FIG. 7.
Figure 3:
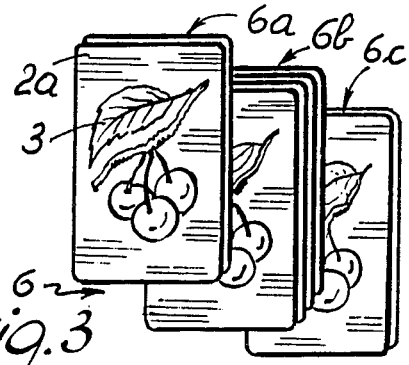
Figure 6:
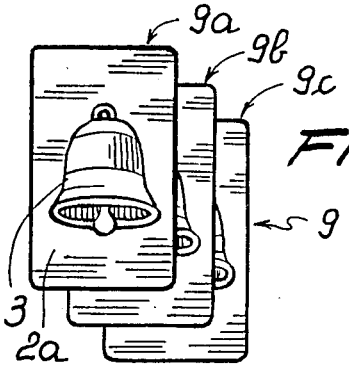
Figure 4:
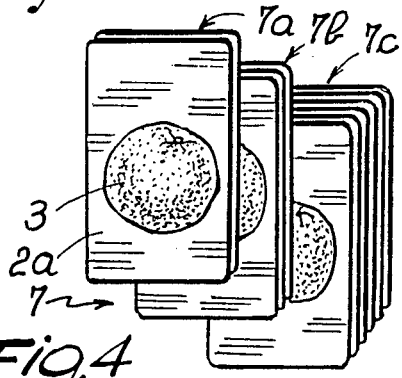

With reference to the drawing figures, a pack of playing cards according to this invention is generally designated 1.

It comprises, for example, fiftyfour cards 2, each having an obverse face *2a* and a reverse face *2b*, both faces being marked.

Figure 7:
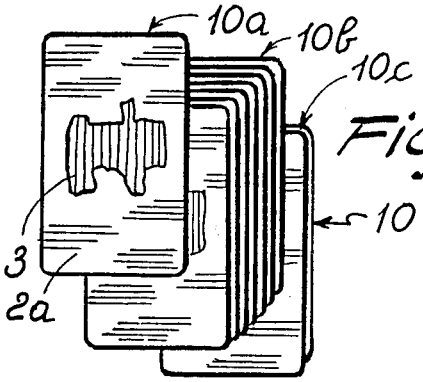
Figure 5:
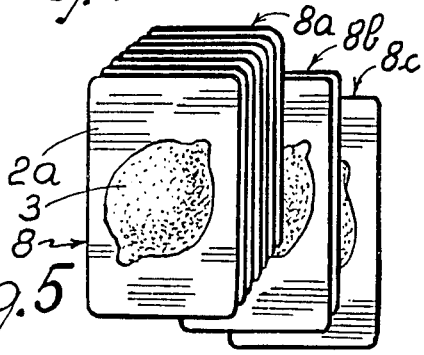

Each obverse face *2a* has first markings 3 thereon which consist preferably of pictures of the same kind as are used with slot machines and/or at least one advertising picture, symbolically depicted in FIG. 7.

Each reverse face *2b* has second markings 4 thereon which consist of characters, such as the letters A,B,C of FIG. 1, and alternatively, of progressive numbers.

In the preferred embodiment shown, there are provided six first markings 3 and three second markings 4. Each marking 3,4 identifies one card 2 and each second marking 4 is printed on eighteen cards 2.

According to the first markings 3, the cards 2 are classed in six suits 5,6,7,8,9 and 10 as shown in FIGS. 2,3,4,5,6 and 7, respectively. Each suit 5–10 carries the same first marking 3.

According to the second markings 4, the cards 2 are classed in three sets 1*a*, 1*b* and 1*c* .

As shown in the drawing, whereas the sets 1*a*, 1*b*, 1*c* comprise cards in equal numbers, namely eighteen cards, the suits 5–10 mainly have cards in different numbers, namely: the first suit 5 (FIG. 2) includes twelve cards; the second suit 6 (FIG. 3) eight cards; the third suit 7 (FIG. 4) eleven cards; the fourth suit 8 (FIG. 5) ten cards; the fifth suit 9 (FIG. 6) three cards; and the sixth suit 10 (FIG. 7) ten cards.

Those cards 2 which are associated with one another by carrying both the same first marking 3 and the same second marking 4 form sub-suits, designated in the drawing with the same numerals as the suits 5–10, with letters a,b,c added according to whether a sub-suit belongs to the first set 1*a*, second set 1*b*, third set 1*c*, respectively.

It is contemplated that each said suit be subdivided into a number of sub-suits which at least approximates the number of sets, and preferably, each suit would include a sub-suit for each set.

Furthermore, within each suit 5–10, the sub-suits have mainly different numerical consistencies.

It should be emphasized that the sub-suits 5*a*,5*b*,5*c* include four, one and seven cards, respectively; the sub-suits 6*a*,6*b*,6*c* include two,four and two cards, respectively; the sub-suits 7*a*,7*b*,7*c* two, three and six cards, respectively; the sub-suits 8*a*,8*b*,8*c* seven, two and one card, respectively; the subsuits 9*a*,9*b*,9*c* one card each; and the sub-suits 1O*a*,1O*b*,1O*c* two, seven and one card, respectively.

The pack 1 of playing cards according to the invention may be used in a variety of ways, depending on the rules of a game to be played.

In particular, the cards lends themselves for chance games which involve a range of possibilities and probabilities to gain which are quite varied.

As an example, an extremely simple form of utilization would consists of dispensing a card from each set to all the players.

Alternatively, the cards may be laid on a table in side-by-side rows of downturned cards, each row comprising a card from each set. The players would pick up either cards from a row or a diagonal array.

In any case, winning hands would be two and three of a kind, and scores would be computed in relation to the probabilities of each two and three of a kind being drawn, which are approximately as follows for the pack shown.

Once the score for drawing two cards of a kind from either the first suit 5 or the third suit 7 has been assigned the reference value of "one", two of a kind from the fourth suit 8 or the sixth suit 10 would carry a value of "two", two of a kind from the second suit 6 would carry a value of "three", and two of a kind from the fifth suit 9 would carry a value of "ten". Also based on the same reference, three of a kind from the third suit 7 would carry a value of "five", three of a kind from the first suit 5 would would carry a value of "eight", three of a kind from the second suit 6 would carry a value of "twelve", three of a kind from the fourth suit 8 or the sixth suit 10 would carry a value of "fifteen", and three of a kind from the fifth suit 9 would carry a a value of "two hundred".

As may be seen, even with simple games as specified above, comparable with the games of chance to be played on slot machines, a wide range of drawing probabilities are afforded. Further, these probabilities would vary in a non-proportional manner in moving from twos to threes of a kind.

This is due to the varied distribution of the cards in the suits, as well as to their varied distribution in the sub-suits, the latter distribution being independent of the former.

Furthermore, owing to the variety and the subdivision of the pack into three sets, it becomes more difficult to foretell the cards yet to be drawn out.

It should be emphasized, lastly, that the markings provided afford immediate visualization of the cards being played, and that the advertising pictures are in full view because of their partaking to the game.

I claim:

1. A pack of playing cards comprising: a plurality of cards having obverse faces, first markings on said obverse faces, reverse faces oppositely from said obverse faces, and second markings selectively applied to said reverse faces, a plurality of card suits, each comprising cards carrying like first markings, at least some of said suits being also diversified from one another by the number of the cards comprising them, a plurality of card sets, each comprising cards carrying said second mutually alike markings, said sets including an equal number of cards, and a plurality of sub-suits of cards, each comprising cards carrying both first and second mutually alike markings, each said suit including a number of said sub-suits which at least approximate the number of said sets, and at least some of said suits including sub-suits which differ from one another by the number of their cards.

2. A pack of playing cards according to claim 1, wherein there are provided three of said sets of cards, six of said suits of cards, and a number of said sub-suits for each said suit which is equal to the number of said sets.

3. A pack of playing cards according to claim 1, wherein said suits of cards mainly comprise a different number of cards each from that of the others of said suits.

4. A pack of playing cards according to claim 1, wherein at least most of said card suits comprise each of said mutually different sub-suits of cards for the number of cards which comprise them.

5. A pack of playing cards according to claim 1, wherein said first markings comprise selectively pictures of the type of those used with slot machines and advertising symbols.

* * * * *